US010052889B2

(12) United States Patent
Yang

(10) Patent No.: US 10,052,889 B2
(45) Date of Patent: Aug. 21, 2018

(54) DIGITAL IMAGING PROCESS FOR FLOORING MATERIAL

(71) Applicant: HANGZHOU HONGYING DIGITAL TECHNOLOGY CO., LTD., Hangzhou (CN)

(72) Inventor: Ning Yang, Arcadia, CA (US)

(73) Assignee: HANGZHOU HONGYING DIGITAL TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 15/178,508

(22) Filed: Jun. 9, 2016

(65) Prior Publication Data

US 2016/0368283 A1 Dec. 22, 2016

Related U.S. Application Data

(62) Division of application No. 14/480,107, filed on Sep. 8, 2014, now Pat. No. 9,387,700.

(Continued)

(51) Int. Cl.
*B41J 11/00* (2006.01)
*B41J 3/407* (2006.01)

(Continued)

(52) U.S. Cl.
CPC ..... *B41J 11/007* (2013.01); *A47G 27/0275* (2013.01); *B41J 3/4078* (2013.01); *B41J 11/002* (2013.01); *B41J 15/048* (2013.01); *B41M 5/0047* (2013.01); *B41M 5/0064* (2013.01); *B41M 7/00* (2013.01)

(58) Field of Classification Search
CPC ..... B41J 11/007; B41J 3/4078; B41J 15/048; B41J 11/002; A47G 27/0275; B41M 5/0047; B41M 5/0064; B41M 7/00; B65H 5/085; B65H 5/10; B65H 5/12; B65H 5/14; B65H 5/16; B65H 5/18; B65H 29/02;

(Continued)

(56) References Cited

U.S. PATENT DOCUMENTS 2,705,693 A 4/1955 Dildilian et al.
3,994,683 A 11/1976 Zimmer et al.

(Continued)

FOREIGN PATENT DOCUMENTS

CN 201202020 Y 3/2009
EP 0159635 B1 9/1990

(Continued)

OTHER PUBLICATIONS

Burkinshaw, Stephen M. Color Science '98. The Unversity of Leeds, 1999. vol. 2: Textile Dyeing & Printing.

(Continued)

*Primary Examiner* — Patrick King
(74) *Attorney, Agent, or Firm* — Wilson Sonsini Goodrich & Rosati

(57) ABSTRACT

A method is provided for imaging fibrous polyamide flooring material. Images are formed on fibrous polyamide flooring material having vivid color and color saturations by piezoelectric digital means without going through washing process or discharging hazardous chemicals. The energy-saving and environmentally friendly method can produce high resolution product with durability and longevity.

8 Claims, 3 Drawing Sheets

Related U.S. Application Data

(60) Provisional application No. 61/875,621, filed on Sep. 9, 2013.

(51) Int. Cl.

| | |
|---|---|
| ***B41J 15/04*** | (2006.01) |
| ***A47G 27/02*** | (2006.01) |
| *B41M 5/00* | (2006.01) |
| *B41M 7/00* | (2006.01) |

(58) Field of Classification Search
CPC ..... B65H 29/04; B65H 29/06; B65H 29/045; B65H 2405/462; B65H 2405/57
See application file for complete search history.

(56) References Cited

U.S. PATENT DOCUMENTS

| | | | | |
|---|---|---|---|---|
| 4,087,311 | A | 5/1978 | Bylund | |
| 4,114,534 | A | 9/1978 | Kudlich et al. | |
| 4,141,231 | A | 2/1979 | Kudlich | |
| 4,142,684 | A | 3/1979 | Schweitzer | |
| 4,336,753 | A | 6/1982 | Vidalis | |
| 4,355,063 | A | 10/1982 | Palmer et al. | |
| 4,441,883 | A | 4/1984 | Vavala | |
| 4,622,041 | A | 11/1986 | Nichols, Jr. | |
| 4,683,002 | A | 7/1987 | Mirua et al. | |
| 4,771,497 | A | 9/1988 | Fleissner | |
| 5,022,336 | A * | 6/1991 | Iwase | B65H 5/16 112/103 |
| 5,093,962 | A | 3/1992 | Farrington et al. | |
| 5,096,764 | A | 3/1992 | Terry et al. | |
| 5,098,590 | A | 3/1992 | Dixit et al. | |
| 5,116,243 | A | 5/1992 | Wills | |
| 5,133,099 | A | 7/1992 | McBride et al. | |
| 5,153,317 | A | 10/1992 | Ortega et al. | |
| 5,509,257 | A * | 4/1996 | Tagliaferri | B65B 35/205 53/252 |
| 5,727,783 | A * | 3/1998 | Tassinari | B65H 29/003 271/182 |
| 5,821,177 | A | 10/1998 | Elgarhy | |
| 6,129,350 | A * | 10/2000 | St. Ours | B41F 13/03 198/644 |
| 6,250,795 | B1 | 6/2001 | Kochanowicz et al. | |
| 6,351,274 | B1 | 2/2002 | Hawkins et al. | |
| 6,776,468 | B2 | 8/2004 | Miller et al. | |
| 6,786,971 | B2 | 9/2004 | Anderson | |
| 6,789,471 | B2 | 9/2004 | Zimmer et al. | |
| 6,854,146 | B2 | 2/2005 | Stoyles et al. | |
| 6,884,493 | B2 | 4/2005 | Magee et al. | |
| 7,130,711 | B2 | 10/2006 | Dabrowa et al. | |
| 7,306,384 | B2 | 12/2007 | Adachi et al. | |
| 7,333,877 | B2 | 2/2008 | Dabrowa et al. | |
| 7,374,808 | B2 | 5/2008 | Sellman et al. | |
| 7,673,378 | B1 | 3/2010 | Weiner | |
| 7,918,062 | B2 | 4/2011 | Chen | |
| 8,082,057 | B2 | 12/2011 | Allen et al. | |
| 8,155,776 | B2 | 4/2012 | Bittner et al. | |
| 8,328,349 | B2 | 12/2012 | Hook et al. | |
| 8,435,339 | B2 | 5/2013 | Koyano et al. | |
| 9,387,700 | B2 | 7/2016 | Yang | |
| 2002/0034607 | A1 | 3/2002 | Stoyles et al. | |
| 2003/0074744 | A1 | 4/2003 | Cliver et al. | |
| 2003/0163875 | A1 | 9/2003 | Cliver et al. | |
| 2005/0018026 | A1 * | 1/2005 | Nerad | B41J 3/28 347/102 |
| 2005/0037174 | A1 | 2/2005 | Streeton et al. | |
| 2005/0056337 | A1 | 3/2005 | Magee et al. | |
| 2005/0081314 | A1 | 4/2005 | Rogers et al. | |
| 2005/0129902 | A1 | 6/2005 | Magee et al. | |
| 2007/0076073 | A1 | 4/2007 | Hornby | |
| 2007/0236545 | A1 * | 10/2007 | Baker | B41J 11/0065 347/85 |
| 2012/0040287 | A1 | 2/2012 | Wang et al. | |
| 2013/0155145 | A1 | 6/2013 | Gotou et al. | |
| 2013/0286120 | A1 * | 10/2013 | Kobayashi | B41J 11/002 347/102 |
| 2014/0063085 | A1 * | 3/2014 | Warner | B41J 3/28 347/4 |
| 2014/0101962 | A1 * | 4/2014 | Priebe | B41J 11/002 34/236 |
| 2015/0077491 | A1 | 3/2015 | Yang | |

FOREIGN PATENT DOCUMENTS

| | | | | |
|---|---|---|---|---|
| EP | 0210157 | B1 | 8/1991 | |
| EP | 0317662 | B1 | 10/1992 | |
| EP | 0631005 | A1 | 12/1994 | |
| EP | 1290258 | B1 | 8/2006 | |
| EP | 1890198 | A1 * | 2/2008 | B41J 11/007 |
| EP | 1905589 | A1 | 4/2008 | |
| EP | 1675995 | B1 | 3/2009 | |
| EP | 2311917 | A1 | 4/2011 | |
| EP | 2412761 | A1 | 2/2012 | |
| EP | 2474656 | A1 | 7/2012 | |
| GB | 651324 | A | 3/1951 | |
| WO | WO-02061194 | A1 | 8/2002 | |

OTHER PUBLICATIONS

International search report and written opinion dated Jan. 27, 2015 for PCT/US2014/054600.

Needles, Howard L. Textile fibers, dyes, finishes, and processes: a concise guide. Noyes Publications, 1986.

Notice of allowance dated Mar. 9, 2016 for U.S. Appl. No. 14/480,107.

Office action dated May 1, 2015 for U.S. Appl. No. 14/480,107.

European Search Report dated Oct. 16, 2017 for European Patent Application No. EP14841972.4.

* cited by examiner

DIGITAL IMAGING PROCESS FOR FLOORING MATERIAL

CROSS-REFERENCE

This application is a divisional application of U.S. patent application Ser. No. 14/480,107, filed Sep. 8, 2014, which application claims the benefit of U.S. Provisional Application No. 61/875,621, filed Sep. 9, 2013, each of which is entirely incorporated herein by reference.

BACKGROUND OF THE INVENTION

Fibrous carpet and/or rug are nowadays used broadly for flooring materials. Most of these materials consist of synthetic polymeric compounds, with other high end materials by natural materials such as wool and silk, etc. The United States carpet and rug industry consumes nearly 50% of the total global production; among these about half are nylon based materials. Due to the fact that both manufacturing and coloring/imaging flooring material involved energy and chemicals, effective use of energy and materials is of a great consideration of the impact toward environment.

Commonly, three different coloring methods are used to bring colors and/or images to fibrous type of flooring materials: wet dyeing, solution dyeing and color printing including monochromatic printing. Among these, wet dyeing and printing are more often used because they are more suitable for a variety of color requirements and images. Moreover, the printing process can be operated at an on-demand therefore substantially decrease the inventory burden.

Screen printing such as flatbed screen printing, either manual or automatic process, is the major and common technique for fibrous flooring material imaging. A pre-made screen with carefully selected and oriented dithering small holes is to be used by mechanically processing color paste through these tiny holes onto the surface of the flooring material producing various color patterns. The process bears disadvantages of long preparation time and high short run cost. If more than one color needed, multiple steps of making screens and overlapping of these color pastes are to be used.

In recent years, digitally controlled color paste discharging or jetting techniques are used to generate color images making flooring materials. Examples of these mechanical jetting or discharging techniques include ChromaJet® and Millitron® injection dyeing for carpet and rugs. Both techniques, however, suffer from the fact that high viscosity 'inks' are used, with excessive amount of colorants and gels. As a result, in addition to the fixing or curing energy needs, excessive amount of water and energy are required for washing away the oversaturated and un-reacted colorants. As much of 10 to 15 gallons water consumption and waste water treatment are associated in producing carpet/rugs associated with the above imaging methods. Furthermore, these mechanical jetting techniques typically suffer from low printing resolution of less than 100 dot-per-inch (DPI) and may not satisfy photographic image needs for high quality image applications.

Chemicals and volatile organic compound (VOC) from the high viscosity paste oversaturated dyeing or printing often are released into the environment. For instance, unreacted benzidine-based azo dyes are considered to be carcinogenic. Plastisol compounds discharged into water systems may pollute environment permanently. Large quantity of salt, often from excessive amount of acid/based neutralization as a result of high viscosity pasted technique, is also a huge problem for waste water treatment. Heavy machinery needs for the washing process is also a burden from cost-effective consideration.

A need exists to produce fibrous flooring materials, with high resolution color imaging without creating, or reducing, environmental or energy burdens.

SUMMARY OF THE INVENTION

An imaging method with equipment is provided for fibrous flooring materials in accordance with an embodiment of the invention. The process is directed to using low viscosity aqueous acid dye inks onto the fibrous flooring materials. Such materials is capable of reacting with the acid inks, producing permanent and vivid color images without going through a washing process.

This invention relates to imaging of fibrous nylon flooring materials capable of reacting with acid dye inks in the existence of aqueous media. The imaging process can be carried out by low viscosity digital printing inks formulated with acid dyes at a belt feed type transporting mechanism on a printer with no excessive colorant, thereby omitting the after-treatment process. This process is high efficiency, energy-saving and low cost.

Piezoelectric type of drop-on-demand printing, especially full color printing technique is a high resolution material imaging method using low viscosity inks. Various types of colorants and chemicals may be formulated into these inks to meet different application and chemical needs. Near stoichiometric dispense of chemicals can be effectively used and adjusted for reactive ingredients in the inks, which may be as tiny as picoliter in quantity, thus permitting high resolution images.

An aspect of the invention provides a multiple-step method for imaging flooring material, the method comprising receiving the flooring material, pre-treating the flooring material using aqueous pre-treatment agent, digitally printing an image on the flooring material using an ink with aid of a piezoelectric printhead, curing the flooring material, with aid of a steamer, by steaming the flooring material and applying an elution liquid to the flooring material allowing colorant in the ink to penetrate through piles of the flooring material, and drying the flooring material, thereby yielding a finished imaged flooring material.

An additional aspect of the invention may include a device for imaging flooring material, the device comprising: a conveyor belt comprising one or more protruding pins configured to engage with the flooring material; and a piezoelectric printhead configured dispense ink to the flooring material, wherein the conveyor belt is positioned beneath the piezoelectric printhead such that ink from the printhead falls toward the conveyor belt, and is configured to convey the flooring material longitudinally relative to the piezoelectric printhead.

Additional aspects and advantages of the present disclosure will become readily apparent to those skilled in this art from the following detailed description, wherein only exemplary embodiments of the present disclosure are shown and described, simply by way of illustration of the best mode contemplated for carrying out the present disclosure. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the invention will be obtained by reference to the following detailed description that sets forth illustrative embodiments, in which the principles of the invention are utilized, and the accompanying drawings of which:

DETAILED DESCRIPTION OF THE INVENTION

While preferable embodiments of the invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

It is to be understood that the terminology used herein is used for the purpose of describing specific embodiments, and is not intended to limit the scope of the present invention. It should be noted that as used herein, the singular forms of "a", "an" and "the" include plural references unless the context clearly dictates otherwise. Any reference to "or" herein is intended to encompass "and/or" unless otherwise stated. In addition, unless defined otherwise, all technical and scientific terms used herein have the same meaning as commonly understood by one of ordinary skill in the art to which this invention belongs.

The invention provides systems and methods for imaging for flooring material. Imaging for flooring material may include dyeing or adding color to flooring material. Various aspects of the invention described herein may be applied to any of the particular applications set forth below or for any other types of material imaging. The invention may be applied as a standalone device or method, or as part of an integrated digital imaging system. It shall be understood that different aspects of the invention can be appreciated individually, collectively, or in combination with each other.

A method is provided for digitally imaging fibrous flooring material that is suitable for reacting with acid dyes. The method comprises multiple steps of printing and treatments, using low viscosity color inks. In some embodiments, the method does not require any washing of the imaged flooring materials, and no waste water discharge is created, thereby providing an energy saving and environmentally friendly process.

Figure 1:
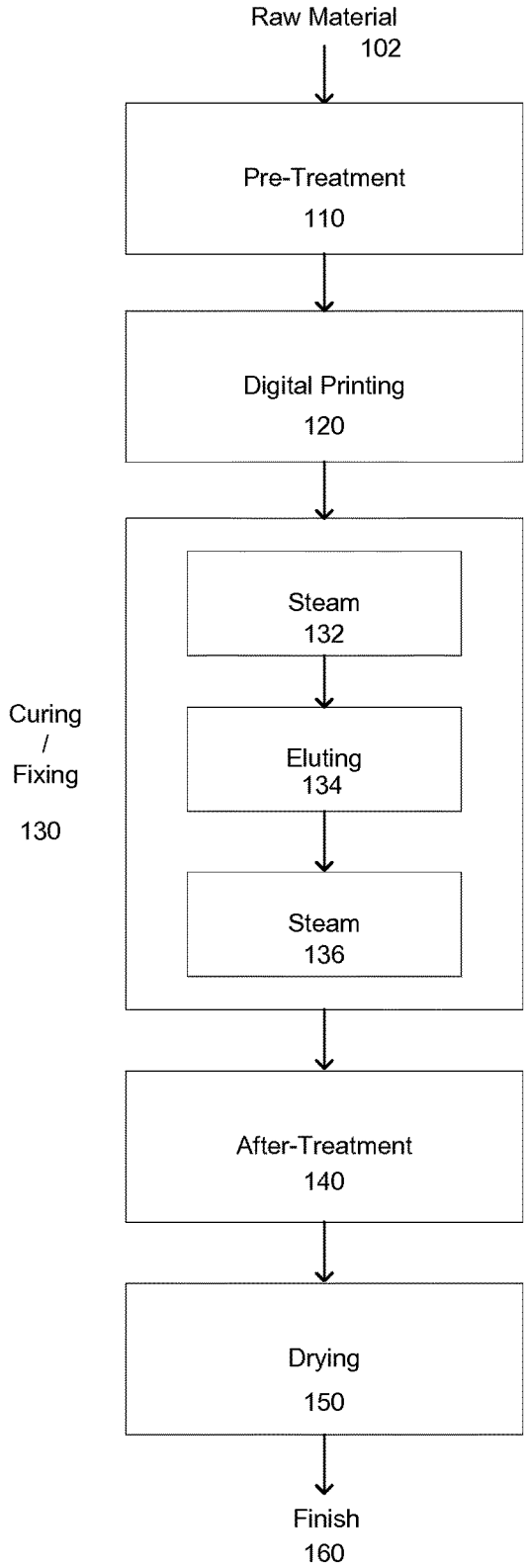
FIG. 1 demonstrates an imaging equipment work flow process of digitally printing fibrous flooring materials according to an embodiment of the invention, where five segments of the equipment are listed.

FIG. 1 provides an example of a method for imaging flooring material. The method may include one or more, or two or more of the following steps: pre-treatment 110, digital printing 120, curing/fixing 130, after-treatment 140, and drying 150. In some instances, a curing/fixing step may include one or more steaming 132, 136 and/or eluting 134 step. Optionally, no washing step is provided in the process. The steps may be provided in the order illustrated, or may optionally occur in different orders. One or more steps may be removed or additional intermediary steps may be provided. In some instances, one or more of the steps may be repeated. Examples of the one or more steps are described in greater detail elsewhere herein.

The method for imaging flooring material may include providing a raw material 102. For example, the raw material may be provided for pre-treatment 110. The raw material may be a flooring material, such as a fibrous flooring material. The raw material may include nylon, or another material with amide groups. In some instances, the raw material may not yet be imaged. For example, a raw material does not have a dye yet applied to it. Further descriptions of possible flooring materials may be provided elsewhere herein.

A finished product 160 may be provided subsequent to undergoing the imaging method. The finished product may include a flooring material that has been imaged and/or colored. An imaged flooring material may have an image applied to the flooring material (e.g., via a dye). The flooring material may be imaged to a high degree of resolution. For example, the resolution of an image on the flooring material may be greater than or equal to about 100 dots per inch, 200 dots per inch, 300 dots per inch, 400 dots per inch, 500 dots per inch, 600 dots per inch, 800 dots per inch, 1000 dots per inch, or 1200 dots per inch. Any description of dots per inch may also be applied to corresponding dots per square inch.

In some embodiments, the finished flooring product 160 may be created without requiring a wash step. For instance, no wash may be required between providing a raw material 102 and receiving the finished flooring product. Optionally, no wash step to remove excess ink/dye/colorant is provided or needed between applying an ink/dye/colorant or other imaging material to the flooring product and providing the finished product.

In some instances, an entirety of the flooring product may be imaged. An entire rug or set of carpeting may undergo the imaging process without requiring the rug or carpet be divided or taken apart. In some instances, the flooring material may have any area. For example, the flooring material may have an area of greater than about 1 square meter, 2 square meters, 3 square meters, 4 square meters, 5 square meters, 7 square meters, 10 square meters, 15 square meters, 20 square meters, 25 square meters, 30 square meters, 40 square meters, 50 square meters, 70 square meters, 100 square meters, 150 square meters, or 200 square meters. Equipment used in the imaging process may be configured to accommodate a flooring material having an area described herein.

In another embodiment of the invention, a set of equipment is provided, suitable for digitally imaging nylon fibrous flooring materials involving multiple stages of operation. In some embodiments, the equipment may permit one, two, or more of the following operations: pre-treatment, digital printing, curing/fixing, after-treatment, or drying. The various stages of operation may be provided in a single piece of equipment or may be distributed over multiple pieces of equipment. In some instances, a dedicated portion of equipment may be provided for each stage. Alternatively, a piece of equipment may be capable of doing two or more of the operations described herein.

In some embodiments, the various stages of the operation may progress with aid of human intervention and/or manual manipulation. Alternatively, one or more of the stages of the operation may occur automatically without requiring human intervention or interaction. In some cases, a combination of automatic and manual operation may be used. One or more action of the pre-treatment, digital printing, curing/fixing, after-treatment, and/or drying stages may occur with aid of a programmable processor. In some embodiments, the transition from a stage to another stage may be implemented with aid of a programmable processor. For example, an automated process may be provided for transferring flooring material from one station to another station at different stages of the operation. In some embodiments, one or more devices may be provided to assist with governing the implementation of the flooring material imaging process. The one or more devices may include a memory and a processor. The memory may be capable of storing non-transitory computer readable media that may comprise code, logic, or instructions for performing one or more steps. The processor may execute one or more steps indicated by the non-transitory computer readable media, which may affect action by the equipment used at various stages of the operation.

The equipment may use digital imaging color inks to achieve high resolution and vivid color images including full color photographic images using the method above and described elsewhere herein. The inks may be paste-free. The inks may be aqueous or liquid. The inks can be printable via a commercial piezoelectric printhead or printing mechanism, where small ink droplets can be dispensed at picoliter level at high speed, and high resolution with multiple color or full color creation simultaneously without having to go through lengthy screen making process. High speed may be several hundreds to several thousands square meters per hour continuously. High resolution of the printed ink may be greater than or equal to about 100 dots per inch, 200 dots per inch, 300 dots per inch, 400 dots per inch, 500 dots per inch, 600 dots per inch, 800 dots per inch, 1000 dots per inch, or 1200 dots per inch. The equipment may include a printing component used in one or more stage of operations.

Contrasting from screen printing method and mechanical digital jetting methods, the systems and methods described herein may use non-paste low viscosity inks, that is, color inks suitable for inkjet applications, substantially free from adhesives, binders, or gelling agents. Especially useful for the systems and methods herein are color inks or ink sets suitable for reacting with materials comprising amide functional groups, such as nylon (including nylon 6, and nylon 66), wool and silk, etc. Materials comprising one or more of such synthetic materials, natural materials, or any combination thereof, may be used in embodiments of the invention. A preferable material for the flooring material may be or may include nylon (e.g., polyamide, either Nylon 6 or Nylon 66 (aka. Nylon 6-6), or a combination of the two) in chemical composition.

Colorants including dyestuff capable of reacting with amide and/or polyamide functional groups can be used. The dyestuff may include but is not limited to acid dyes, metallic acid dyes, certain reactive dyes, cationic dyes such as basic dyes, or combinations thereof. These colorants may go through a chemical reaction with amide function groups at controlled conditions (e.g., temperature, humidity and/or acidity) and form permanent bonding with the material comprising the amide function groups, therefore creating a chemically stable and permanent color image. Generally, acid dyes may be preferably used. Examples of controlled conditions (e.g., temperature and humidity ranges) are provided elsewhere herein.

Flooring materials may have images applied thereon using one or more printing devices. Printing may occur at a digital printing station. Such digital printing devices may include piezoelectric drop-on-demand (DOD) printers or certain continuous inkjet printers. These printers may be equipped with printheads or printing mechanisms (e.g., only suitable for low viscosity inks ranging from several centipoises to no more than 100 centipoises). Examples of manufacturers of these types of printhead include Fuji Dimatix®, Fuji Xerox®, Trident®, Epson®, Brother®, Ricoh®, Siemens®, etc. In these DOD inkjet systems, a piezoelectric actuator may squeeze ink liquids controlled by a computer or other digital means, forcing tiny ink droplets ejected from the print head through dithering patterns onto the substrate or printed media, creating color images.

The printing device may be capable of applying ink to the flooring material by permitting the ink droplets to fall into the flooring material. A printhead of the printing device may move relative to the flooring material. In some instances, the flooring material may be stationary as the printhead applies ink to the flooring material. Alternatively, the flooring material may be in motion as the printhead applies ink. For example, a flooring material may be capable of moving longitudinally relative to the printing device (e.g., carried by a belt or other mechanism), while the printhead may move laterally to distribute ink across the flooring material. The printhead may move in a direction substantially perpendicular to a direction that the conveyor belt is conveying the flooring material. The distance of the printhead to the flooring material may remain substantially the same while the printhead moves.

A special type of piezoelectric DOD print head may be used in accordance with an embodiment of the invention. An internal ink circulation chamber can be built inside the print head or printing mechanism, immediately prior to the piezoelectric injection. Ink fluid is circulated inside the print head independent of the printing action. Such circulation not only provides agitation to the ink fluid, providing means preventing insoluble ingredients from settling, but may also provide a relatively high sheer force, especially suitable for pseudo-Newtonian (thixotropic) ink fluid. Under such fluid circulation, thixotropic fluid may remain at a low viscosity, and therefore may be easily injected from the DOD print head without problems. Manufacturers of this type of print head include, for example, Fuji Dimatix® and Xaar®.

In some embodiments, a digital printing station may include one or more ink channels for color ink. The digital printing station may include one or more channels for colorless ink. Optionally, the digital printing station may include at least a first ink channel for color ink and at least a second ink channel for colorless ink. A printhead may optionally include a first ink channel for color ink and a second ink channel for colorless ink.

In some embodiments, inks having a viscosity ranging from 2 to 100 centipoises, 5 to 50 centipoises, 7 to 30 centipoises, or preferably 10 to 20 centipoises may be used. In some embodiments, low viscosity inks may be less than or equal to 100 centipoises, 75 centipoises, 50 centipoises, 40 centipoises, 30 centipoises, 25 centipoises, 20 centipoises, or 15 centipoises. The primary carrier of these inks can be water. Other ingredients that may be used include physical property adjustment chemicals/agents such as surfactant, wetting agent, dispersing agent, penetration agent, biocide, acidity/pH adjustment chemicals or buffer chemical, humectants or glycols, pH adjustment agent, or chelating agent. Chemicals impacting or controlling the reaction rate of the acid dye with the amide functional group may also be used depending on the specific acid dye that is/are used in each color ink, so that proper reaction speed amongst different colors can be achieved.

In general, ink sets with primary colors (i.e. Cyan, Magenta, Yellow and Black) may be used in the systems and methods described herein. Such primary colors may achieve substantial color range for most applications. In some instances, other inks besides one, two, three or four primary colors need not be used. However, other colors may also be used to enhance the color coverage and/or special image color needs. Commonly used other ink color may include Green, Orange, Blue/Turquoise, Red, Grey, or light colors of each. Inks may be mixed or applied in layers to create desired color effects. White color inks and/or colorless inks may also be used for the purpose of adding reactive chemicals, such as catalyst, penetration agent, grafting chemicals or polymeric materials may be used according to the needs of the applications in different ink printing channels, in addition to the main teachings of the invention. Colorless inks may also be used for the purpose of color adjustment and/or special imaging effect. For instance, a primary color ink set (e.g., Cyan, Yellow, Magenta, and Black) may be used through four ink channels, while another one to four ink channels (which may be provided in a separate printhead or the same printhead) can be colorless inks. The combination may achieve much broader color results by adjustment of ratios of each color ink and colorless ink(s).

A typical ink formulation for the color inks may be shown by the following example:

| Ingredient | weight % |
|---|---|
| Acid dye (colorant as dry powder) | 0.5-10 |
| Water soluable Solvent/Cosolvent/humectants | 1-60 |
| Ink property adjustment agent | 0-10 |
| Biocides | 0-5 |
| Water | balance |

Surface tension of inks can be within the range of 25 to 55 mN/m, or preferably within the range of 30 to 45 mN/m. Depending on the specific flooring construction and pile/yarn density, color ink application may range from 25 grams to 180 grams per square meter, typically at image printing quality from 300 to 1200 dot per inch resolution, or any other resolution described elsewhere herein.

In some embodiments, based on the type of flooring material (e.g., pile/yarn density), one or more print settings may be determined. For example, the level of color ink application (e.g., grams/square meter) may be determined based on one or more flooring material parameters. The flooring material parameters may be received by a flooring imaging system. The parameters may be input by a user, or may be determined with aid of one or more sensors. For example, the weight, area, height, or type of flooring material may be sensed with aid of one or more sensors. Examples of parameters may include, but are not limited to, pile/yarn density, yarn height/thickness, yarn material, or other characteristics of the flooring material. The determination of the print settings may be calculated with aid of a processor. For example, a flooring material with greater yarn density may have a higher application of ink compared to a flooring material with less yarn density. In another example, depending on yarn height or thickness of the flooring material, the printhead height may be adjusted.

A thixotropic agent, sometimes referred to as a thickening agent, a rheology control agent, or a gelling agent may also be used in the inks described herein, as an optional ingredient. Inks containing thixotropic agent may allow the inks to remain on the surface of the flooring material after printing until force is applied at a later stage. The thixotropic agent may also help stabilizing inks comprising insoluble ingredient(s) by limiting particle Browning movement, known as an adverse effect on ink stability. Various thixotropic agents may be used, including inorganic and/or organic/polymeric thixotropic agents. In some cases, a combination of different thixotropic agents may be used. Depending on specific print head and ink application, the thixotropic agent may be used at a level between 0.1% to 5% by weight (e.g., may have a concentration greater than, less than or equal to about 0.1%, 0.3%, 0.5%, 1%, 1.5%, 2%, 2.5%, 3%, 3.5%, 4% or 5% by weight).

The amount of reactive ingredients in the inks, especially the acid dyes printed onto the flooring materials, can be regulated stoichiometrically, in accordance with an embodiment of the invention. This adjustment and regulation may ensure proper color generation without wasting the colorants or chemicals after the entire imaging process, hence obtaining a high economic efficiency and effectiveness. Furthermore, the adjustment and regulation may prevent requiring a wash step which may also provide environmental benefits. Paste ink-based printing methods such as screen printing, or conventional mechanical jetting digital means require excessive amount of reactive ingredients in the ink pastes. The majority of the colorants, VOC ingredients, and adhesive/gel materials are washed away after the reaction, causing material, mechanical, energy, time efficiency and environmental challenges.

Colorants, such as acid dyes, can be regulated at between 85% and 110% relative to the reactable/fixable functional group sites, and preferably between 95% and 105%. The control of the specific efficiency in terms of percentage may be obtained through trial-and-error by adjusting ink concentrations and ink printing densities. The additive nature of the digital piezoelectric DOD inkjet mechanism and consistent inkjet droplet size/volume can enable such regulation. A digital inkjet printing mechanism allowing the proper ejecting of the acid dye inks onto the flooring material may be provided as part of the imaging equipment for the flooring material. The digital inkjet printing mechanism may comprise at least one piezoelectric DOD print head and a carriage mechanism mounting the print head above the feed transporting belt.

Different construction type of flooring materials, with the characteristics of comprising amide functional groups, may be used. Various types of carpet/rugs may be used, such as those with three basic constructions, cut pile (Saxony, textured, and Frieze), twist pile (Frieze), and loop pile (level loop, multiple-loop, and cut and loop pile). These construction structures provide fibrous configurations with channels or micro-channels between fibrous piles/yarns allowing printing inks to penetrate with gravity and/or capillary forces. Uncoated pile flooring materials with pile height between 1 and 15 millimeters, and/or pile weight between 150 and 1500 grams per square meter may be used. Preferably, pile height between 3 and 9 millimeter and/or pile weight between 300 and 1000 grams per square meter may be used.

In some embodiments, a method of imaging material, such as the method illustrated in FIG. 1, may be implemented using one or more stations. The stations may be located in physically distinct locations or may be integrated at a single location. Examples of stations may include a pre-treatment station, digital printing station, curing/fixing station, after-treatment station, and/or drying station. Optionally, an automated process may be provided which may permit flooring material to travel from one station to another, or one portion of a station to another portion without requiring human intervention.

A pre-treatment station in the equipment of the flooring material imaging system may be provided. The pre-treatment station may allow the pretreatment to be applied prior to the printing of acid dye inks. A pre-treatment station in the entire equipment chain may provide the application of the pre-treatment fluid/chemicals and also vacuum and/or force airflow (either at ambient temperature or elevated temperature) to remove excessive fluid and/or chemicals. Pre-treatment may help remove air bubbles in the structure channels/micro-channel between piles/yarns, allowing better surface contact between ink droplets and amide functional group comprising substrate, and better penetration of the inks into the lower portion of the flooring material. Furthermore, pre-treatment fluid may also alter the surface energy of the polymeric pile/yarns, improving the wetting property of the acid ink onto the flooring materials. In some cases, the pre-treatment fluid may be an aqueous pre-treatment agent. Typical pre-treatment methods include pad, spray, roller or other methods. A digital dispensing method such as inkjet printing may also be used.

One preferable pre-treatment method may use on-demand digital printing mechanisms of various types. In addition to avoiding over application, this can allow precise and real time control of the pre-treatment fluid/chemicals to be applied to the flooring materials in the necessary areas but not in the areas that do not require treatment, thus further enhancing the efficiency. Various types of on-demand digital printhead technologies may be used in the printing mechanism such as thermal/bubble jet, continuous inkjet, piezoelectric inkjet, and/or solenoid valve jet print/coat head. Examples of manufacturers of the latter include but are not limited to The Lee Company, and Printos®.

Pre-treatment fluid of the flooring material may be illustrated by the following formulary example:

| Ingredient | weight % |
|---|---|
| Water soluble Solvent/Cosolvent/humectants | 0-15 |
| Fluid property adjustment agent | 0-5 |
| Penetration agent | 0-5 |
| Water | balance |

Surface tension of the pre-treatment fluid can be preferably adjusted between 35 and 66 nN/m.

For high pile flooring materials especially cut pile carpet/rug, vacuum drying after the application of the pre-treatment can be performed. Vacuum applied from the surface of the flooring material helps the piles/yarns to maintain a uniform, consistent and upright position, enhancing the printing quality of the final printing image. The pretreatment and vacuum drying operation may be applied as dynamic movement during the entire imaging process as the flooring material can move through the application of the pretreatment fluid and vacuum drying prior to the printing.

Flooring material, such as full display carpet, may be very heavy. Therefore transporting the carpet at a steady movement can be important for uniform operations. Adhesive based transporting belts possess many disadvantages, and can be relatively short lived, especially for heavy printing materials.

In one embodiment, a belt feed system can have rigid pins, such as metallic pins, mounted at the surface of the transporting belt. These pins, holding from the backside of the flooring material, can carry the flooring material continuously throughout the imaging equipment, with dimensional stability. The flooring material may be capable of being transported via the belt feed system by lying flat on the belt.

Figure 2:
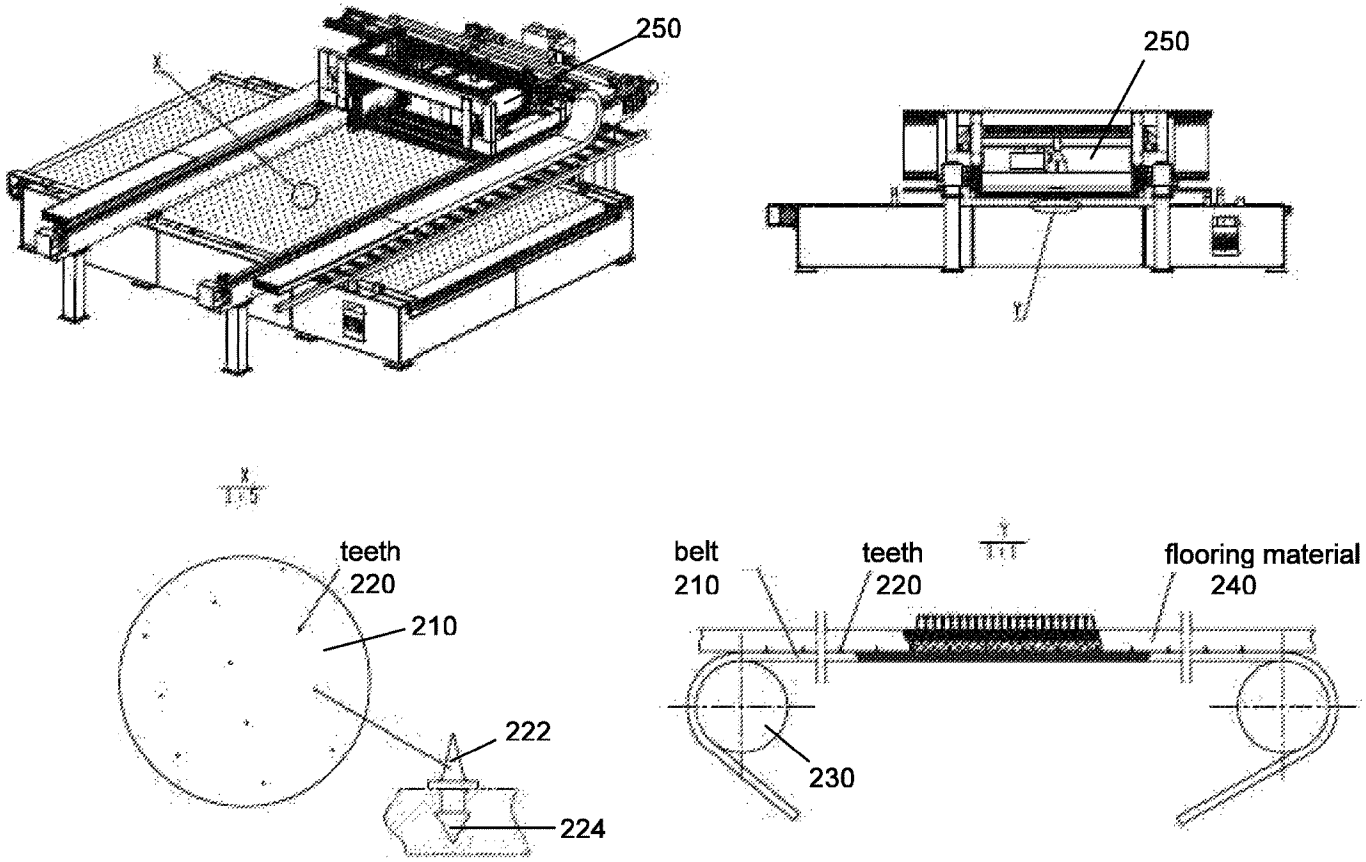
FIG. 2 illustrates a belt feeding mechanism of flooring material carrying/transporting during an imaging process according to an embodiment of the invention.

FIG. 2 provides an example of a belt feed system using pins. The belt surface 210 may have one or more pins 220 provided thereon. The pins may cover at least a portion of the belt surface. The pins may be provided in one or more row and/or one or more column. In some instances, the pins may be arranged as an array or staggered rows/columns on the belt surface. The pins may be distributed in any pattern or in a random manner on the belt surface.

The belt 210 may overlie one or more roller 230. The rollers may turn, thereby causing movement of the belt. The pins 220 may be provided on a belt surface opposing the surface of the belt that contacts the rollers. The pins may be configured to contact flooring material 240. The pins may be capable of digging into and/or gripping the flooring material as the flooring material is transported by the belt. The pins may penetrate a portion of the flooring material. The flooring material may rest on the belt surface, held by the pins, and be moved as the rollers turn.

In some embodiments, the pins 220 may be formed from a rigid material. For example, the pins may be formed from metal or metal alloy, wood, plastic, mineral, or any other material. The pins may optionally have a pointed exposed end 222. Alternatively, the end of the pin may be flat or rounded. The distal end of the pin further away from the belt surface may optionally have a smaller cross-sectional area than a proximal end of the pin closer to the belt surface. An embedded end 224 of the pin may be embedded within the belt surface. The embedded end may keep the pin attached to the belt surface. The embedded end may optionally have a barbed, hooked or similar shape that may permit the pin to be inserted into the belt surface and then remain attached to the belt surface. Any description of a barbed or hooked shape may include an embedded end that has a cross-sectional area of a first portion deeper into the conveyor belt that is greater than a cross-sectional area of a second portion that is not as deep into the conveyor belt. The cross-sectional area may drop rapidly from the first portion to the second portion. A shelf or other surface may be formed such that a deeper portion of the embedded end may hook or catch onto the conveyor belt to be held firmly onto the conveyor belt. Adhesives may or may not be used to affix the pin to the conveyor belt. The pin may be configured to remain protruding from the belt surface. A longitudinal axis of the pin may remain substantially orthogonal to the belt surface.

This may permit the effective transport of the flooring material from the beginning to the end without fluctuation of the flooring material tension at different stages (impacting the movement speed). This may also maintain the flat surface and constant gaps between print head and flooring material surface. Depending on the specific flooring material and a backing layer (such as polypropylene or polyester film/membrane), pins (e.g., metallic pins) on the transporting belt may have various different thickness/diameter and sharpness. Various configurations of the pin tips may be used. Preferable height of the metallic pins can be between 5% and 75% of the entire flooring material. In some instances, the height of the metallic pins may be greater than, less than, equal to, or fall between two or more of the following: 5%, 10%, 15%, 20%, 25%, 30%, 35%, 40%, 45%, 50%, 55%, 60%, 65%, 70%, or 75% of the flooring material. The relative dimensions may refer to the exposed length of the pin in relation to the thickness of the flooring material.

Optionally, a printhead or other printing mechanism 250 may be provided. The belt 210 may keep the flooring material 240 moving relative to the printing mechanism. The printing mechanism may provide dye to the flooring material while the flooring material passes between the printing mechanism and the belt surface. The pins 230 may keep the flooring material suitably flat against the belt to provide a relatively constant distance between the flooring material and the printhead. The flooring material may be substantially flush against the belt, thereby preventing bumping that may interfere with or contact the printhead. Printing on the flooring material may occur in accordance with various embodiments and examples as described elsewhere herein.

One or more print setting may be selected in accordance with the type of flooring material. For example, belt speed, printhead height, density of ink applied, type or mix of ink applied may be selected based on the type of flooring material. Such settings may be manually entered, or may be determined automatically with aid of a processor in response to information about the flooring material.

In some embodiments, other equipment may be provided with similar configurations to the printhead. For example, dryers, steamers, pre-treatment devices, or after-treatment devices may be provided over the flooring material while the flooring material is on a belt. The flooring material may be stationary or may be moving while the various pieces of equipment are in use.

A multi-step fixing/curing portion of the imaging equipment may be provided, where the flooring materials can go through a fixing and/or curing process. In some instances, the fixing/curing process may include three steps.

Figure 3:
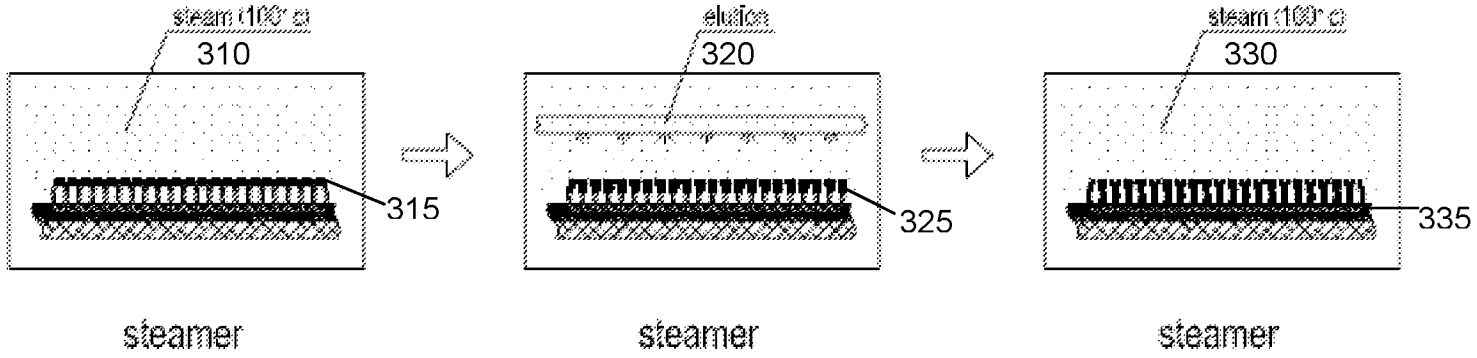
FIG. 3 demonstrates a two-stage fixing/curing of printed fibrous flooring material according to an embodiment of the invention.

FIG. 3 illustrates a principle of the multiple curing/fixing operations. As described in relation to FIG. 1, the curing/fixing operations may include steaming 310, elution 320, and then steaming 330. A three step process is provided by way of illustration but is not to be considered limiting. For example, a five step process may be provided alternating between steaming and elution. Any number of steps may be provided for steaming and elution. The steps may occur within a steamer. In some instances, the steaming an elution steps may occur within the same steamer.

After the desired color images printed onto the surface, the flooring material can be transported, via the pinned belt feeding transporting mechanism, into a curing/fixing station. For example, the flooring material may be transported to a steamer. The flooring material may remain on a pinned belting arrangement in the steamer. The steamer may have a closed configuration isolated from external conditions, or may have an open configuration which is at least partially exposed to external conditions. The flooring material may lie flat at the curing/fixing station.

High temperature steam (e.g., greater than, less than, equal to one or more of the following: about 85 degrees C., 90 degrees C., 100 degrees C., 110 degrees C., 120 degrees C., 130 degrees C., 140 degrees C., 150 degrees C.) can be applied. The steam may optionally have an 80% to 100% humidity level. At this step, the majority of the acid inks can be maintained at the upper segment of the pile structure, allowing a relatively over-saturated ink level during the chemical reaction process between amide functional group and the acid dyes. In the meantime, an ink concentration gradient 315 can be formed while the acid dye inks are migrating deeper into the lower portion of the material. Steam temperature ranging from 85° C. to 150° C. may be used for preferably 3 minutes to 10 minutes. This condition ensures the relative completion of the color curing/fixing of the upper segment of the flooring material, therefore achieving the most effective visual color optical density.

An aqueous penetration elution liquid, according to the imaging process, can then be applied followed by the previous steaming step. Spraying method may be used with optional pressurized elution liquid so that proper penetration result 325 can be achieved. This step may assist the unreacted acid dye inks with migrating quickly into the deeper segment of the pile/yarn. The elution liquid may allow or assist colorant in the dye ink in penetrating through piles of the flooring material. To further assist the penetration, an adjustment roller underneath the spraying mechanism may also be used to create a convex position of the flooring material, further opening ink migration channels. The convex portion of the flooring material may have a longitudinal axis that may be parallel to a direction of motion of the flooring material along a conveyor belt. Alternatively, the longitudinal axis of the convex portion of the flooring material may be perpendicular to a direction of motion of the flooring material along a conveyor belt.

In order to effectively accelerate the ink migration and also consistent curing/fixing with the remainder of the acid dye inks, the aqueous penetration elution liquid may comprise at least one water soluble or water miscible acidity shifting agent. These acidity shifting agents can remain substantially neutral at ambient temperature in aqueous environment, but can become acidic in property at elevated temperature, either through dissociation of the hydrogen bonding, decomposing of the chemical structure, or hydrolyzing. Typically these agents are organic materials containing at least one hydroxyl functional groups and/or at least one ester functional groups, with the acid portion of the ester structure a low molecular weight organic acid such as formic acid, acetic acid, glycolic acid, citric acid, or lactic acid. The low molecular organic acid may be evaporated or decomposed under drying conditions at elevated temperatures, for instance, 200° C.

Examples of the acidity shifting agent can include, but are not limited to, glyeryl acetate, glyceryl diacetate, ammonium citrate, ammonium lactate and urea.HCl and the like. Preferable penetration elution liquid composition may be illustrated by the following table:

| Ingredient | weight % |
|---|---|
| Acidity shifting agent | 0-10 |
| Humectants | 0-10 |
| Fluid property adjustment agent | 0-5 |
| pH buffer | 0-5 |
| Water | balance |

The penetration elution fluid may be applied, according to the specific flooring construction and pile weight/height, from 5% to 35% of the pile weight. Typically the penetration elution fluid is applied at ambient temperature while the treated flooring material moving to the next steam curing/fixing step.

After the application of the penetration elution fluid, the originally concentrated acid dye inks can be moved to the middle and lower segment of the pile configuration 335, as illustrated in FIG. 3. The flooring material can be transported to the third step of the curing/fixing process. High temperature steam with 80% to 100% humidity level is again applied with the temperature ranging from 85° C. to 150° C., preferably at 100° C. At this step, all or substantially all acid dyes molecules can be reacted with the amide functional groups on and within the flooring material.

Optionally, the application of penetration elution liquid followed by the steam fixing/curing may be repeated to optimize the curing/fixing. This may be done by inserting an extra portion of the imaging equipment in line to enhance the quality as needed, especially for high pile flooring carpet materials.

Household or commercial flooring materials such as carpets and rugs, often need to be treated with chemicals to enhance color fastness, stain-resistance, and/or abrasion-resistance, generally called after-treatment. In-line after-treatment may be provided to apply and/or dispense needed chemicals. These chemicals can be commercially available and may be used according to the formulations, quantity and combination known to the skilled in the art. One embodiment provides the application of these chemicals using foaming mechanism so little or no excessive chemicals are used. Proper foaming agent with foaming generating peripherals can be used in-line accordingly. The quantity of the chemicals can be controlled so that little or no excess amount of the after-treatment chemicals to be discharged into the environment.

The imaging equipment may include a drying oven. A preferable drying temperature may fall between 100° C. and 225° C., and more preferably between 185° C. and 205° C. This may allow the completion of the remainder of the acid dye reaction and also the removal of the acidity shifting agents without damaging the chemical structure or the aesthetic appearance of the flooring material. Electric, fuel (such as propane gas), microwave, or other heating mechanism (or their combinations) may be used for the purposes according to the general teachings of the art.

The imaging equipment may have five portions including Pre-treatment, Digital Printing, Curing/Fixing, After-Treatment, and Drying. These portions may be mounted continuously, or segmented based on specific application needs. A preferable operation, due to economic considerations, can be to continuously operate. This way, no extra transporting cost or extra peripheral parts may be required. This may be highly beneficial for wall-to-wall or large dimension flooring materials where heavy machinery is desired for each moving operation. For small on demand application, such as door mats or rugs, however, segmented operation may be suitable for the purpose of small footprint.

In some embodiments, continuous operation and/or the segmented option may occur automatically and require little or no manual intervention during the process. One or more portion of the process may be automated and may be operated with aid of a processor.

It should be understood from the foregoing that, while particular implementations have been illustrated and described, various modifications can be made thereto and are contemplated herein. It is also not intended that the invention be limited by the specific examples provided within the specification. While the invention has been described with reference to the aforementioned specification, the descriptions and illustrations of the preferable embodiments herein are not meant to be construed in a limiting sense. Furthermore, it shall be understood that all aspects of the invention are not limited to the specific depictions, configurations or relative proportions set forth herein which depend upon a variety of conditions and variables. Various modifications in form and detail of the embodiments of the invention will be apparent to a person skilled in the art. It is therefore contemplated that the invention shall also cover any such modifications, variations and equivalents.

What is claimed is:

1. A device for imaging flooring material, the device comprising:

a conveyor belt comprising one or more protruding pins configured to engage with the flooring material by at least partially penetrating a portion of the flooring material, wherein each of the one or more protruding pins has a barbed or hooked shaped end embedded in the conveyor belt surface; and a digital printing station with a piezoelectric printhead configured for dispensing ink to the flooring material, wherein the conveyor belt is positioned beneath the piezoelectric printhead such that ink from the printhead falls toward the conveyor belt, and wherein the conveyor belt is configured to convey the flooring material longitudinally relative to the piezoelectric printhead.

2. The device of claim 1 wherein the printhead is configured to move relative to the flooring material in a direction perpendicular to the longitudinal movement of the flooring material via the conveyor belt.

3. The device of claim 1 wherein the printhead includes an internal ink circulation chamber configured to circulate ink within the printhead.

4. The device of claim 1 wherein each of the one or more pins have a pointed exposed end on a first surface of the conveyor belt, wherein the first surface is opposing a second surface of the conveyor belt that contacts one or more rollers that drive movement of the conveyor belt.

5. The device of claim 1 wherein the height of the pins falls between 5% and 75% of the flooring material.

6. The device of claim 1 wherein the printhead is configured to dispense ink to the flooring material at a resolution of 300 dots per inch or greater.

7. The device of claim 1 wherein the one or more protruding pins are attached to the conveyor belt.

8. The device of claim 1 wherein a longitudinal axis of the one or more protruding pins is oblique to a surface of the conveyor belt that contacts the flooring material.

* * * * *